US008590301B2

(12) United States Patent
Wood

(10) Patent No.: US 8,590,301 B2
(45) **Date of Patent: *Nov. 26, 2013**

(54) FREE-PISTON STIRLING MACHINE FOR EXTREME TEMPERATURES

(75) Inventor: James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/310,827

(22) Filed: Dec. 5, 2011

(65) Prior Publication Data

US 2012/0144821 A1 Jun. 14, 2012

Related U.S. Application Data

(60) Provisional application No. 61/422,689, filed on Dec. 14, 2010.

(51) Int. Cl.
*F02G 1/043* (2006.01)

(52) U.S. Cl.
USPC ..... 60/520; 60/518; 60/524; 60/525

(58) Field of Classification Search
USPC ..... 60/518–525
See application file for complete search history.

(56) References Cited

U.S. PATENT DOCUMENTS

| | | | | |
|---|---|---|---|---|
| 4,559,779 | A | 12/1985 | Brown | |
| 5,095,699 | A * | 3/1992 | Blackshear | 60/516 |
| 7,000,390 | B2 * | 2/2006 | Wood | 60/520 |
| 7,866,153 | B2 | 1/2011 | Sollie et al. | |
| 2006/0179833 | A1 * | 8/2006 | Qiu et al. | 60/520 |
| 2009/0094977 | A1 * | 4/2009 | Hill | 60/520 |

* cited by examiner

*Primary Examiner* — Thomas Denion
*Assistant Examiner* — Shafiq Mian
(74) *Attorney, Agent, or Firm* — Frank H. Foster; Kremblas & Foster

(57) ABSTRACT

A free piston Stirling machine including a thermal buffer tube extending from the machine's expansion space and surrounded by its heat rejector and its regenerator, a displacer cylinder extending from the thermal buffer tube to the compression space and surrounded by the heat rejecting heat exchanger, and a displacer that reciprocates within an excursion limit that extends into the regenerator by no more than 20% of the length of the regenerator during normal operation and preferably within excursion limits that are substantially the length of the heat rejector.

15 Claims, 4 Drawing Sheets

FREE-PISTON STIRLING MACHINE FOR EXTREME TEMPERATURES

CROSS-REFERENCES TO RELATED APPLICATIONS

This application claims the benefit of U.S. Provisional Application No. 61/422,689 filed 14 Dec. 2010. The above prior application is hereby incorporated by reference.

STATEMENT REGARDING FEDERALLY-SPONSORED RESEARCH AND DEVELOPMENT

This invention was made with Government support under contract NNC07CA11C awarded by NASA. The Government has certain rights in the invention.

REFERENCE TO AN APPENDIX (Not Applicable)

BACKGROUND OF THE INVENTION

This invention relates to free piston Stirling machines and more particularly relates to a free piston Stirling machine that is adapted for use in applications where its component parts that are in the region of its expansion space are subjected to extreme temperatures.

Free piston machines, including free piston engines, coolers and heat pumps, have been applied to a variety of purposes in a variety of environments. Typically they have a compression region of the machine that operates at a temperature that is nearer to their ambient temperature and an expansion region that operates at a temperature that is farther from their ambient temperature. The expansion region is usually at one end of a generally cylindrical head and is either much colder than the ambient temperature, as in the case of a cryocooler, or the expansion region is much hotter than the ambient temperature, as in the case of a engine.

These temperature extremes present difficult design problems because of the temperatures themselves and because of the temperature differential between the component parts in these regions and the parts in the remainder of the machine. Some component parts extend into both the region of extreme temperature and the region of more moderate temperature. Typical problems include selecting materials that can maintain their characteristics and function properly at the extreme temperature and selecting the dimensions of the component parts and selecting machining tolerances to accommodate thermal expansion and contraction of the materials.

The design of a free piston Stirling engine for use in interplanetary travel is an example of the need to contend with extreme temperatures. The temperature of the atmosphere on Venus is on the order of 500° C. Because heat is applied to the heater head of an engine to power the engine, for use on Venus there is a need for a heater head that can withstand on the order of 1100° C. One of the most difficult component parts to design in a manner that can accommodate the extreme temperature is the displacer of the free piston Stirling machine. The reason is that the displacer of a free piston Stirling machine not only reciprocates along an axial path between the compression space with the moderate temperature and the expansion space with the more extreme temperature but the displacer also extends essentially all the way from within a heat rejecting heat exchanger at the compression space, through a regenerator to within a heat accepting heat exchanger at the expansion space. Consequently, the reciprocating displacer is subjected to an extreme temperature differential between its opposite ends with a temperature gradient along its length.

Efficient work is done in a free piston Stirling machine by transferring heat into the working gas at the expansion space and transferring heat out of the working gas at the compression space. Heat that is instead transferred through the displacer is wasted or lost heat representing inefficiency. Therefore, displacers are designed to minimize the heat transfer through the displacer from one end to its opposite end. Consequently, a typical displacer has a thin walled dome at its expansion space end fixed on top of a more rigid supporting piston at its compression space end. Examples of such displacers are illustrated in U.S. Pat. Nos. 4,559,779 and 7,866,153. The dome typically has an axial length that is considerably longer than its rigid supporting piston and its purpose is to thermally isolate the hot and cold spaces (expansion and compression spaces). The dome is a thin walled and essentially hollow structure in order to minimize its mass and to minimize heat conduction through the metal of the displacer. The displacer usually has baffles in the interior of the displacer dome to function as radiation shields and to subdivide the space in order to limit gas convection within the displacer and thereby limit heat transfer through the displacer between the expansion space and the compression space. Typically there are 3 to 6 baffles tack welded inside the displacer. Such displacers are expensive to manufacture and subject to thermal expansion/contraction. The metal, especially of the dome, must be able to withstand the extreme temperatures of the expansion space. Furthermore, the baffles can also be a reliability problem, especially if they become detached from the interior wall of the displacer dome.

An example of a typical prior art free piston Stirling machine 8 is illustrated in FIG. 2. The machine 8 has a hermetically sealed casing 10 containing a displacer 12 connected to a connecting rod 14 that is attached at its opposite end to a planar spring 16. The displacer reciprocates along a central axis 17 within a displacer cylinder 18 and extends between an expansion space 20 and a compression space 22. The displacer cylinder 18 extends within a heat accepting heat exchanger 24, a regenerator 26 and a heat rejecting heat exchanger 28 all of which surround the displacer cylinder 18 and permit working gas to be shuttled between the expansion space 20 and the compression space 22 serially through the heat exchanger 24, regenerator 26 and heat exchanger 28. The working space of the Stirling machine 8 is bounded by a piston 30 that reciprocates in a piston cylinder 31 and is connected to magnets 32 of an electromagnetic linear alternator/motor 34. The time varying pressure within the working space drives the reciprocation of the piston and the displacer.

The prior art has suggested avoiding the problems of the extreme temperature at the expansion space end of a displacer by using a thermoacoustic Stirling heat engine configuration. This configuration eliminates the displacer and substitutes a tuned inertance tube. Consequently it has no moving part that extends to the extreme temperature of the expansion space end of the head. Typically the inertance tube is ¼λ long and extends through a radial port in a generally radial direction out the side of the machine at the heat rejecting, compression space end of the working gas space and returns to the compression space through another radial port.

This thermoacoustic solution, however, introduces several disadvantages. The thermoacoustic Stirling heat engine configuration has a lower efficiency than a Stirling machine using a displacer because of the less than ideal phasing of the working gas through the regenerator and the added gas volume in the inertance tube. Another disadvantage is that a thermoacoustic Stirling heat engine requires a fluid diode for preventing a detrimental, unidirectional, circulating fluid flow component of working gas. There is also the problem of attaching the inertance tube to the casing in a manner that is durable and provides proper gas communication with the compression space. The inertance tube also forms an unwieldy arm that projects out the side of the machine.

It is therefore an object and feature of the present invention to provide a free piston Stirling machine that avoids problems inherent in the presence of extreme hot or cold temperatures to which component parts in the expansion region of a free piston machine are subjected.

Another object of the invention is to avoid the problems presented by the extreme temperatures and yet retain a displacer in the machine so that the higher efficiency of a free piston machine that has a displacer can be attained and the disadvantages of the inertance tube and fluid diode of the thermoacoustic configuration can be avoided.

BRIEF SUMMARY OF THE INVENTION

The invention is a free piston Stirling machine having a displacer that is confined to reciprocation substantially within the heat rejecting heat exchanger that surrounds the displacer cylinder so that no part of the displacer is near or makes excursions near the extreme temperature region of the free piston Stirling machine. A thermal buffer tube extends between the end of the displacer when it is positioned at the boundary of its furthest excursion toward the heat accepting heat exchanger and the distal end of the heat accepting heat exchanger.

Figure 1:
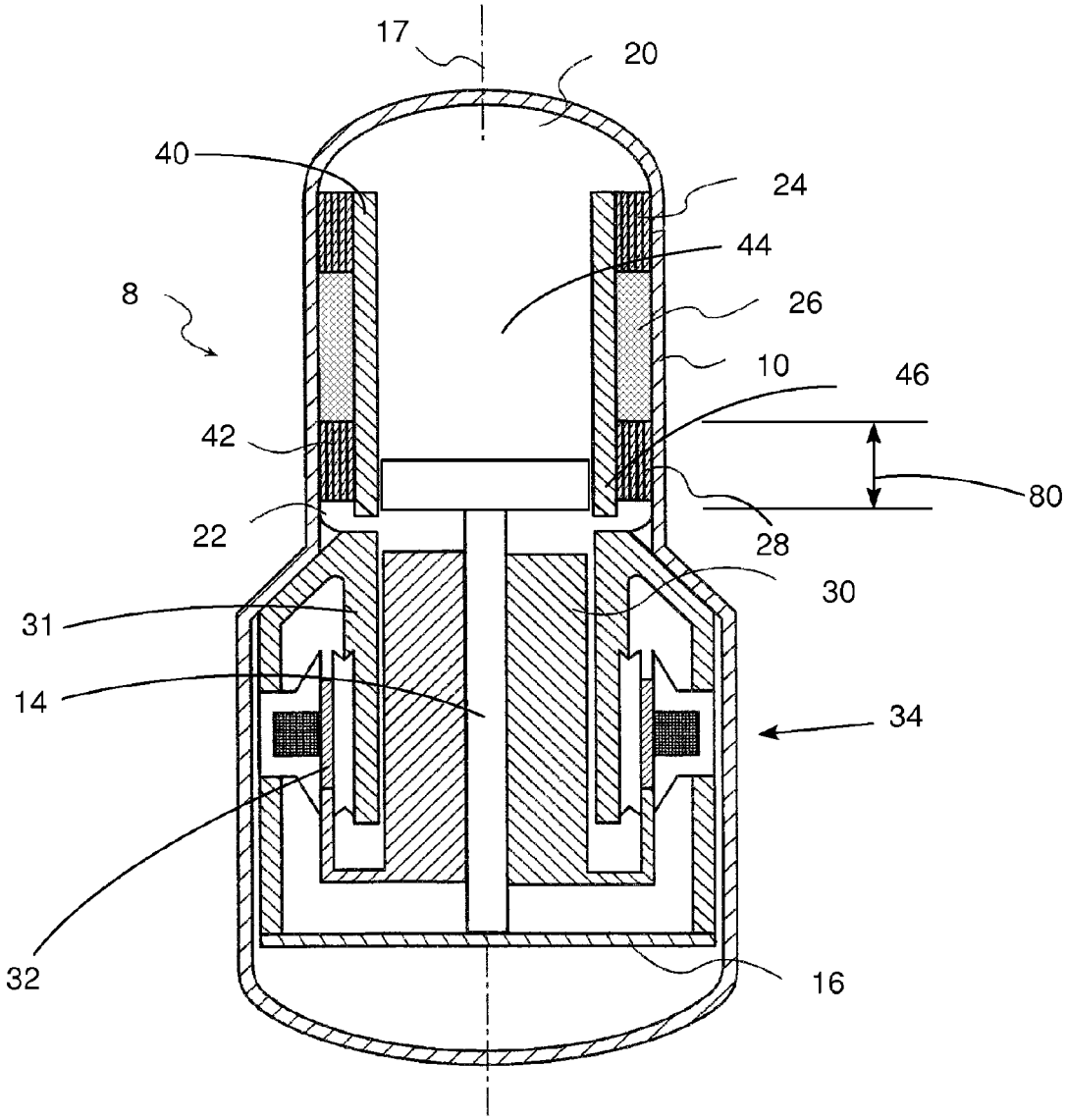
FIG. 1 is a schematic diagram in axial section of a free piston Stirling machine embodying the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Free Piston Stirling Machine Principles

In a Stirling machine, a working gas is confined in a working space that includes an expansion space and a compression space. The working gas is alternately expanded and compressed in order to either do work or to pump heat. Each free piston Stirling machine has a pair of pistons, one referred to as a displacer and the other referred to as a power piston and often just as a piston. The reciprocating displacer cyclically shuttles a working gas between the compression space and the expansion space which are connected in fluid communication through a heat acceptor (heat accepting heat exchanger), a regenerator and a heat rejector (heat rejecting heat exchanger). The shuttling cyclically changes the relative proportion of working gas in each space. Gas that is in the expansion space, and gas that is flowing into or out of the expansion space through a heat exchanger (the acceptor) between the regenerator and the expansion space, accepts heat from surrounding surfaces. Gas that is in the compression space, and gas that is flowing into or out of the compression space through a heat exchanger (the rejector) between the regenerator and the compression space, rejects heat to surrounding surfaces. The gas pressure is nearly the same in both spaces at any instant of time because the spaces are interconnected through a path having a relatively low flow resistance. However, the pressure of the working gas in the work space as a whole varies cyclically and periodically. When most of the working gas is in the compression space, heat is rejected from the gas. When most of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space, then the machine is inclined to produce work so it can function as an engine and if this expansion process temperature is lower than the compression space temperature, then the machine will pump heat from a cold source to a warm heat sink.

Stirling machines can therefore be designed to use the above principles to provide either: (1) an engine having a piston and displacer driven by applying an external source of heat energy to the expansion space and transferring heat away from the compression space and therefore capable of being a prime mover for a mechanical load, or (2) a heat pump having the power piston (and sometimes the displacer) cyclically driven by a prime mover for pumping heat from the expansion space to the compression space and therefore capable of pumping heat energy from a cooler mass to a warmer mass. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps.

Because free-piston Stirling machines can be constructed and operated as an engine, such engines have been linked as a prime mover to a variety of mechanical loads. These loads include linear electric alternators, compressors and fluid pumps and even Stirling heat pumps. Similarly, because free-piston Stirling machines can be operated in a heat pump mode, they have been driven as a load by a variety of prime movers, including linear motors.

The Invention

FIG. 1 is a schematic illustration of an embodiment of the invention. FIG. 1 is similar to FIG. 2 in order to make apparent the principal differences between the invention and the prior art. The same reference numerals have been used in FIG. 1 as used in FIG. 2 and other figures to designate the corresponding component parts and therefore the above description of those component parts is not repeated.

A basic concept of the invention is to form and position the displacer so that its stroke is confined to displacer reciprocation that is substantially within the heat rejecting heat exchanger in order that no part of the displacer is near or makes excursions near the extreme temperature region of the free piston Stirling machine. A further basic concept of the invention is to form a thermal buffer tube that extends from the position of the end of the displacer when the displacer is at the boundary of its furthest excursion (TDC) toward the heat accepting heat exchanger to the distal end of the heat accepting heat exchanger. The invention can eliminate the need for the thin walled dome with baffles and no part of the displacer is subjected to the extreme temperature region at the expansion space of the free piston Stirling machine.

Figure 2:
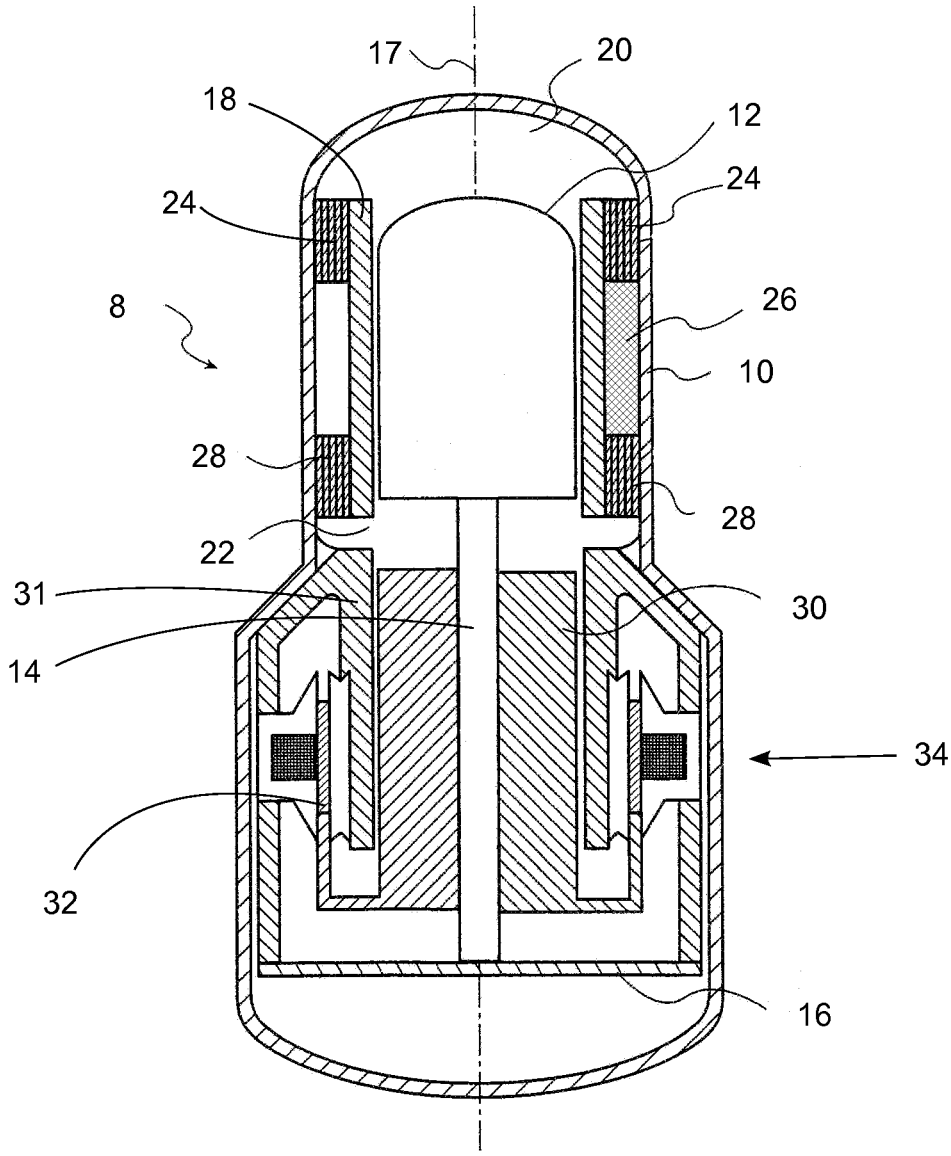
Fig. 2 Prior Art
FIG. 2 is a schematic diagram in axial section of a free piston Stirling machine according to the prior art.

Referring to FIG. 1, a central, tubular cylinder 40, similar to the displacer cylinder 18 of FIG. 2, extends within the heat exchangers 24 and 28 and the regenerator 26. A displacer 42 is reciprocatable within the cylinder 40 and is connected by the displacer rod 14 to the spring 16. However, unlike the prior art of FIG. 2, the displacer 42, the displacer rod 14 and the spring 16 have a size and are positioned to prevent excursion of any part of the displacer 42 beyond the heat rejecting heat exchanger 28 by more than 20% of the length of the regenerator 26 during normal operation. In other words, the displacer 42 does not reciprocate to a position that is within the regenerator 26 a distance that is more than 20% of the length of the regenerator 26. In fact, an excursion into the regenerator 26 by 20% of the regenerator length is believed to be the maximum practical distance for realizing some advantages of the invention. It is most preferred that the displacer 42 does not make excursions beyond the heat rejecting heat exchanger 28. Nonetheless it is also believed that excursions as much as 10% of the regenerator length beyond the heat rejecting heat exchanger 28 still provide significant, although not optimum, advantages of the invention.

Therefore, a part of the central, tubular cylinder 40 forms and functions as a thermal buffer tube 44 extending from the expansion space 20 and surrounded by the heat accepting heat exchanger 24 and the regenerator 26. Another part of the central, tubular cylinder 40 forms and functions as a displacer cylinder 46 extending from the thermal buffer tube 44 to the compression space 22 and is surrounded by the heat rejecting heat exchanger 28.

As seen in FIG. 1, the thermal buffer tube and the displacer cylinder can be, and often are, two parts of a single cylinder. The portion of that cylinder in which the displacer reciprocates functions as a displacer cylinder. The remaining portion of that single cylinder is beyond the range of displacer stroke and functions as the thermal buffer tube which the displacer never enters. However, because their functions are different, alternatively they can be two different tubular structures arranged end to end and in some embodiments that has advantages. The displacer cylinder and the thermal buffer tube can have different diameters and different cross sectional shapes and they can be different materials. Consequently, the terms displacer cylinder and thermal buffer tube apply to those different regions of the single cylinder that perform their respective functions when they are formed as one piece. When they are made of two different pieces those terms apply to the portions of each according to the function of the portions. For example, if the thermal buffer tube and the displacer cylinder are formed of two pieces, competent design would have the piece that functions as the displacer cylinder extending axially in both directions an amount beyond the maximum nominal displacer excursion. The purpose is to prevent collision with the thermal buffer tube and to accommodate excessive excursions that could result from unusual operating conditions. Consequently, a part of the piece that functions as the displacer cylinder will have a short end segment into which the displacer normally does not enter and which, therefore, actually functions as a part of the thermal buffer tube.

The thermal buffer tube separates the heat acceptor and the heat rejector heat exchangers. The purpose of a thermal buffer tube is to pass acoustic energy while minimizing heat transport. The mass of gas in the thermal buffer tube reciprocates in the thermal buffer tube relatively uniformly with minimum turbulence. Typically the thermal buffer tube has a slight taper to help keep the gas from mixing. The taper is not absolutely necessary but is desirable.

With the invention, the thermal buffer tube, instead of a displacer dome, is now the separation between hot and cold spaces (expansion space and compression space) within the machine. The thermal buffer tube has nothing mechanical running inside it so the designer is not concerned with clearances or thermally induced changes of clearance which are problems to be concerned with when there is a displacer dome. With a displacer dome it is difficult to avoid rubbing of the displacer against its cylinder wall, especially in the extreme temperature region of the machine.

Because the function of the displacer cylinder and the thermal buffer tube are different, they can have different shapes and contours as well as different diameters. Because the displacer does not enter the thermal buffer tube, only the displacer cylinder needs to be machined in the precision manner typically required to provide a clearance seal for properly sealing the displacer to its cylinder. The displacer cylinder and the thermal buffer tube can also be two different separate pieces arranged end to end, one a cylinder in which the displacer reciprocates and the other a tubular structures functioning as the thermal buffer tube. Of course the displacer cylinder can extend axially somewhat beyond the opposite excursion limits of the displacer to assure that the displacer does not collide with the thermal buffer tube. When the displacer cylinder and the thermal buffer tube are two different separate pieces, they can also be fabricated from different materials. For example, there are advantages in forming the thermal buffer tube of ceramic material, including the lower thermal conductivity of ceramic which reduces heat conduction through the thermal buffer tube. Although the displacer cylinder can also be formed of ceramic and machined, a metallic displacer cylinder is preferred for reasons later described below.

Figure 3:
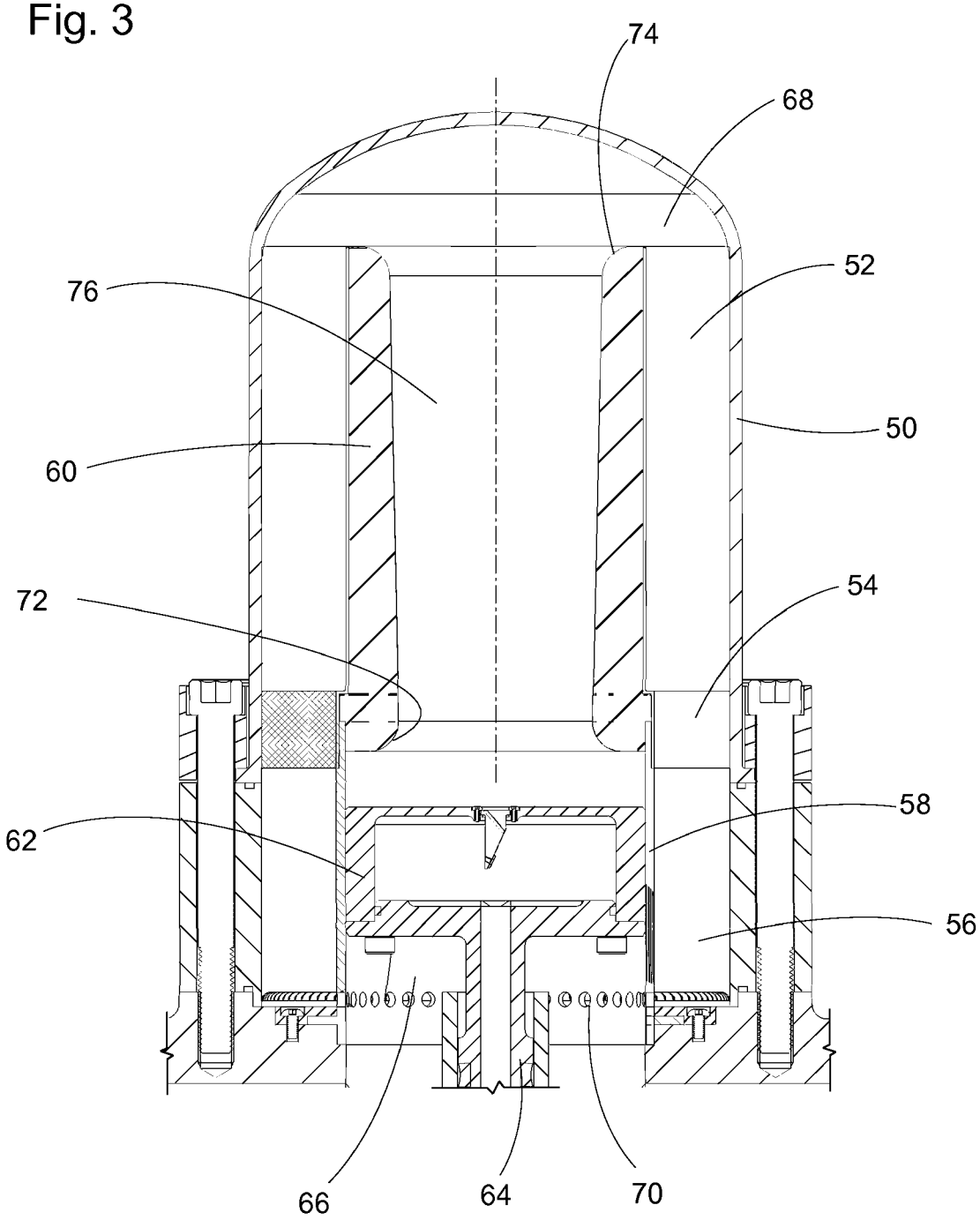
FIG. 3 is a view in axial section of the head of a free piston Stirling machine having an alternative embodiment of the present invention.

FIG. 3 illustrates the head of an embodiment of the invention in which the thermal buffer tube and the displacer cylinder are two different separate pieces arranged end to end and have different shapes and sizes. The casing 50 contains a heat accepting heat exchanger 52, a regenerator 54 and a heat rejecting heat exchanger 56 all annularly arranged around a displacer cylinder 58 and a ceramic thermal buffer tube 60. A displacer 62 has a connecting rod 64 that may be connected to a planar spring or otherwise connected as known in the art. A compression space 66 is at one end of the axially aligned and end to end displacer cylinder 58 and buffer tube 60 and an expansion space 68 is at the distally opposite end.

The thermal buffer tube 60 is tapered from a narrower diameter nearest the displacer 62 to a wider diameter where the thermal buffer tube 60 opens into the expansion space 68. The mean diameter of the displacer cylinder 58 is different from the diameter of the displacer 62 and its cylinder 58. In the embodiment of FIG. 3, the displacer cylinder 58 has a larger internal diameter than the largest internal diameter of the thermal buffer tube 60. The thermal buffer tube 60 is tapered in order to reduce mixing and turbulence of the working gas within the thermal buffer tube 60. The displacer cylinder 58 is, of course, of uniform diameter and at least substantially the axial length of the heat rejecting heat exchanger. The annularly arranged series of radially aligned ports 70 provide a working gas path from the compression space 66 to the heat rejector 56. In order to provide smooth transitions for minimizing gas flow turbulence, the opposite ends of the thermal buffer tube 60 are formed with radiused curves 72 and 74 to provide a smoothly blended transition to the conical surface 76 of the tapered portion of the thermal buffer tube 60. The amount of taper may be expressed as a ratio in units of diameter and is on the order of 3 units at the narrower end to 4 units at the wider end or alternatively a ratio 2 units to 3 units.

An alternative thermal buffer tube, that may be substituted for the thermal buffer tube 60 that is illustrated in FIG. 3, can be constructed as a tube having a hollow annular wall of thin sheet metal or other material. For example, a thin metal sheet can be formed in the shape of (i.e. follow the contour of) the surfaces of the thermal buffer tube 60. Stated another way, the alternative thermal buffer tube could be a hollow toroidal ring that is generated by revolving a plane geometrical figure, in the form of an outline of the cross section of the thermal buffer tube 60 illustrated in FIG. 3, about an axis external to that figure which axis is parallel to the plane of the figure and does not intersect the figure. A buffer tube formed in that manner would have a relatively low conductivity because heat transfer radially through it would principally be conduction through its contained gas.

When designing a displacer, one design goal is to thermally isolate the expansion space from the compression space in order to maximize the temperature differential between the expansion and compression spaces and to minimize heat transfer that occurs other than as a result of expansion and compression of the working gas because such other heat transfer does not represent useful work. As explained above, in the prior art one manner of accomplishing that is by minimizing heat flow through the displacer by forming the displacer with a thin walled dome having spaces and baffles.

However, with the invention, it is desirable to design the displacer to encourage heat transfer through the displacer and therefore a highly conductive displacer is desirable. In order to maintain thermal isolation and the temperature differential between the expansion space and the compression space, it is desirable to remove heat that is transferred through the working gas in the thermal buffer tube between the expansion space and the displacer. Designing the displacer to have a high thermal conductivity through the displacer from its end face that faces the thermal buffer tube to its cylindrical wall facilitates the transfer of that heat to the displacer cylinder for conduction through the displacer cylinder to the heat rejecting heat exchanger and away from the machine. Consequently, there are advantages to forming the displacer so that it is a solid heat conducting metal, such as aluminum, with no thermally isolating cavities. Alternatively, the displacer may be formed with thicker than conventional walls to facilitate heat conduction but still have one or more open cavities. Desirably, the displacer cylinder is formed of the same metal as the displacer so that they have the same coefficient of thermal expansion.

Boundaries of Displacer Excursion

As stated above, an important principle of the present invention is that the displacer is confined substantially within the axial length of the heat rejecting heat exchanger during its reciprocation, although some minor extensions beyond those limits still provides advantages and improvements. FIG. 1 illustrates this preferred displacer excursion range 80 to which displacer excursions are confined. In normal operation the displacer does not make excursions significantly outside of this range. As is common in some free piston Stirling machines, displacer amplitude of oscillation may vary as operating conditions vary so displacer stroke may, at times, be considerably less than the maximum stroke or occasionally be more. In general, embodiments of the invention have a stroke and therefore a displacement that is the same or comparable to prior art free-piston Stirling engines and heat pumps.

The design criteria for confining the displacer stroke are as follows. It is desirable to make the displacer axial length as long as possible because a longer axial length allows a better clearance seal between the displacer and the displacer cylinder. The axial length of the heat rejecting heat exchanger defines to coolest temperature part of the working space. Therefore the optimum design is that the axial length of the displacer is equal to the axial length of the heat rejecting heat exchanger—(less) the displacer stroke. As is often the case with engineering design and engineering tradeoffs, some departure from this optimum can be adopted in order to accomplish some additional purpose.

The reasons for confining displacer excursions to substantially the axial length of the heat rejecting heat exchanger are that the expansion space has the most extreme temperature (the hot end in an engine and the cold end in a heat pump such as a cryocooler) and there is a temperature gradient axially along the length of the thermal buffer tube from the most extreme temperature at the heat acceptor to the more moderate temperature of the heat rejector. Preferably, the displacer of the invention does not enter any part of the machine with a temperature that is elevated above the heat rejector temperature. The typical prior art displacer reciprocates in a cylinder that is surrounded by the regenerator so there is a temperature gradient along that cylinder because of the temperature gradient through the regenerator. The typical prior art displacer also makes excursions into the expansion space and adjacent the heat accepting heat exchanger. Because the displacer of the invention avoids those regions, it doesn't encounter the extreme temperature.

Although it is most desirable to confine the displacer to the more moderate temperature zone of the free piston Stirling machine, as stated above and practically speaking the displacer could travel as much as 10% or even 20% of the distance into the regenerator region and still have advantageous operation. As is often true of the application of technical principles to a practical design, a slight excursion into the regenerator would make only a slight difference and the greater the excursions into the regenerator, the less effective and advantageous the invention. If the machine is designed to permit the displacer to make excursions into the regenerator, at some amount of entry it would be desirable to add a small thermally insulating dome to the displacer or provide a secondary rejector (described below).

It is also preferable to avoid displacer excursions that go toward the compression space much beyond the heat rejecting heat exchanger. The displacer should not interfere with working gas flowing to and from the ports (e.g. 70) that open between the heat rejecting heat exchanger and the compression space. Any such interference that would increase flow resistance or cause added turbulence would reduce the efficiency of the machine.

Secondary Heat Rejector

Figure 4:
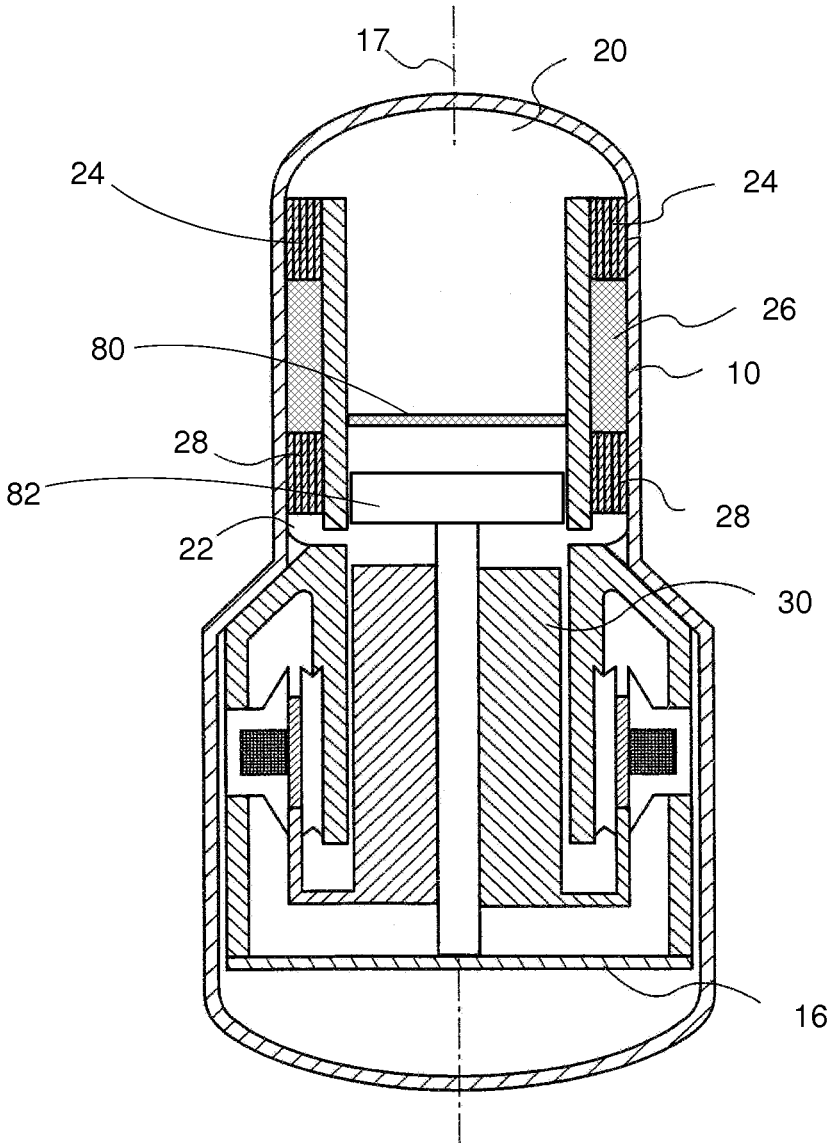
FIG. 4 is a schematic diagram in axial section of a free piston Stirling machine embodying the present invention and having an optional secondary heat rejector.

In the event that the free piston Stirling machine is designed to include the invention but have a displacer that makes short excursions into the more extreme temperatures beyond the heat rejector, it can be desirable to provide a secondary heat rejector. Referring to FIG. 4, a secondary heat rejector 80 extends within and across the thermal buffer tube. The secondary heat rejector 80 is a matrix of conductive metal with interposed gas passages. The matrix is thermally connected at its periphery to interior walls of the thermal buffer tube for removing any heat that is lost down the thermal buffer tube and conducting that heat from the working gas to the walls of the thermal buffer tube. Examples of a secondary heat rejector are a copper screen welded to the tube walls or a brass plug with passages (like a regenerator) sintered together and sintered or otherwise connected in thermal conduction to the wall of the thermal buffer tube.

It is highly desirable that the secondary heat rejector be connected to a thermally conductive metal part of the thermal buffer tube so that the heat is readily conducted from the secondary heat rejector 80 to the heat rejecting heat exchanger 28. However, the secondary heat exchanger 80 must be positioned axially beyond the boundaries of displacer reciprocation so that the displacer does not collide with it. If the thermal buffer tube and the displacer cylinder comprise a two part system, the secondary heat rejector 80 is advantageously connected to an extension of a metal displacer cylinder for maximum heat conduction. However, it is believed that the secondary heat exchanger is not needed if the displacer is sufficiently conductive and is sufficiently confined in its boundaries of reciprocation to within the heat rejector.

Some Advantages of the Invention

The invention makes the free piston Stirling machine less costly to manufacture, even if extreme temperatures are not a design concern, because the invention eliminates the need both to design and to build a displacer dome and baffles in the displacer dome. Only the part of the displacer cylinder in which the displacer reciprocates needs to be machined and, because the displacer of the invention is considerably shorter than a prior art displacer, the axial length of the displacer cylinder that must be machined is shorter. Machining and clearances are only critical in the region of the more moderate temperature compression space and only along the relatively short range to which reciprocation is confined. Beyond the range to which reciprocation is confined, there is nothing to have a clearance and therefore no critical machining is necessary.

Because a thermoacoustic free-piston Stirling engine has on the order of 70% of the efficiency of a free-piston Stirling engine that has a conventional displacer, the invention provides better efficiency than a thermoacoustic free-piston Stirling engine. A free piston Stirling machine using the displacer arrangement of the invention has been computed to get 85% of the efficiency of a free-piston Stirling engine that has a conventional displacer but it avoids the problem of designing a displacer cylinder and a displacer that extends into the extreme temperature regions of the machine.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A free piston Stirling machine including a piston reciprocatable in a piston cylinder open at one end to a working space, a heat accepting heat exchanger adjacent and opening into an expansion space portion of the working space, a heat rejecting heat exchanger adjacent and opening into a compression space portion of the working space and a regenerator extending between and in gas communication between the heat exchangers, the machine further comprising:

(a) a thermal buffer tube extending from the expansion space and surrounded by the heat accepting heat exchanger and the regenerator;

(b) a displacer cylinder extending from the thermal buffer tube to the compression space and surrounded by the heat rejecting heat exchanger; and (c) a displacer reciprocatable within the displacer cylinder and connected to a displacer rod, the displacer cylinder, the displacer, and the displacer rod having a size and being positioned to prevent excursion of any part of the displacer beyond the heat rejecting heat exchanger by more than 20% of the length of the regenerator during normal operation.

2. A free piston Stirling machine in accordance with claim 1 wherein the displacer is a solid heat conductor metal having no thermally insulating cavities.

3. A free piston Stirling machine in accordance with claim 1 wherein the displacer has an axial length that is equal to the axial length of the heat rejecting heat exchanger minus the stroke of the displacer.

4. A free piston Stirling machine in accordance with claim 1 wherein a secondary heat rejector extends within and across the thermal buffer tube, the secondary heat rejector comprising a matrix of conductive metal with interposed gas passages, the matrix being thermally connected at its periphery to interior walls of the thermal buffer tube for conducting heat from working gas to the tube walls.

5. A free piston Stirling machine in accordance with claim 1 wherein the thermal buffer tube and the displacer cylinder are different separate component pieces.

6. A free piston Stirling machine in accordance with claim 1 wherein the displacer cylinder, the displacer and the displacer rod have a size and are positioned to prevent excursion of any part of the displacer beyond the heat rejecting heat exchanger by more than 10% of the length of the regenerator during normal operation.

7. A free piston Stirling machine in accordance with claim 2 wherein the displacer is aluminum.

8. A free piston Stirling machine in accordance with claim 5 wherein the displacer cylinder has a larger internal diameter than the thermal buffer tube.

9. A free piston Stirling machine in accordance with claim 5 wherein the thermal buffer tube is formed of a ceramic.

10. A free piston Stirling machine in accordance with claim 6 wherein the displacer cylinder, the displacer and the displacer rod have a size and are positioned to prevent excursion of any part of the displacer beyond the heat rejecting heat exchanger during normal operation.

11. A free piston Stirling machine in accordance with claim 10 wherein the displacer is a solid heat conductor metal having no thermally insulating cavities.

12. A free piston Stirling machine in accordance with claim 11 wherein the displacer is aluminum.

13. A free piston Stirling machine in accordance with claim 11 wherein the displacer has an axial length that is equal to the axial length of the heat rejecting heat exchanger minus the stroke of the displacer.

14. A free piston Stirling machine in accordance with claim 13 wherein a secondary heat rejector extends within and across the thermal buffer tube, the secondary heat rejector comprising a matrix of conductive metal with interposed gas passages, the matrix being thermally connected at its periphery to interior walls of the thermal buffer tube for conducting heat from working gas to the walls.

15. A free piston Stirling machine in accordance with claim 14 wherein the thermal buffer tube is formed of a ceramic.

* * * * *